United States Patent [19]

Evans

[11] 4,217,742

[45] Aug. 19, 1980

[54] ROOF LOUVER APPARATUS

[76] Inventor: Daniel D. Evans, 5829 N. 17th Pl., Phoenix, Ariz. 85016

[21] Appl. No.: 886,995

[22] Filed: Mar. 16, 1978

[51] Int. Cl.[2] ..... E04D 1/00

[52] U.S. Cl. ..... 52/553; 52/507

[58] Field of Search ..... 52/518, 538, 541, 553, 52/555, 78, 507, 750

[56] References Cited

U.S. PATENT DOCUMENTS

| | | | |
|---|---|---|---|
| 339,744 | 4/1887 | Cusack | 52/553 |
| 2,273,485 | 2/1942 | George | 52/518 |
| 2,620,651 | 12/1952 | Brauer | 52/78 |
| 2,647,290 | 8/1953 | Nachman | 52/78 |
| 2,847,728 | 8/1958 | Shinall | 52/78 |
| 3,001,331 | 9/1961 | Burnton | 52/518 |
| 3,006,113 | 10/1961 | Barnes | 52/553 |
| 3,728,198 | 4/1973 | White | 52/748 |
| 4,023,321 | 5/1977 | Smith | 52/750 |

FOREIGN PATENT DOCUMENTS

| | | | |
|---|---|---|---|
| 2446541 | 4/1976 | Fed. Rep. of Germany | 52/750 |
| 158451 | 8/1921 | United Kingdom | 52/518 |

*Primary Examiner*—Price C. Faw, Jr.
*Assistant Examiner*—Henry E. Raduazo
*Attorney, Agent, or Firm*—H. Gordon Shields

[57] ABSTRACT

Louvered roof apparatus is disclosed which includes a plurality of overhanging louvers to provide shade as an integral part of a roof.

5 Claims, 5 Drawing Figures

ROOF LOUVER APPARATUS

BACKGROUND OF THE INVENTION

1. Field of the Invention

This invention relates to roof apparatus, and, more particularly, to roof apparatus which includes a plurality of louvers disposed partially on top of the next adjacent louver to provide an inherent shading capacity for the roof.

2. Description of the Prior Art

Roof structures fall basically into two categories, the flat roof category and the pitched roof category. In the first category are roofs of buildings and some houses that are primarily flat in nature. Because they are flat, the roof structure is substantially different from the pitched roofs of the second category. The flat roof structures are generally sealed with some type of tar or tar derivative. The tar or similar product is put on the roof over an appropriate roof covering in liquid form. The application of the sealant material in liquid form precludes its use on a pitched roof. Since the roof sealant or sealer is generally a very dark color, typically black, it readily absorbs heat in the form of solar radiation. A light, usually white, coating is often used with the sealer to reflect the solar radiation in an effort to reduce the amount of heat absorbed by the roof.

Broadly speaking, for pitched roofs, which are other than flat, there may be several types of roofing surfaces or finishes. However, a pitched roof typically is covered with shingles, either of the asphalt type or of the shake type. Regardless of the type of shingle or shingles used, the shingles overlap each other to provide for drainage of rain and snow from the roof. Shingles are normally made from cedar and accordingly are tan or brown. As time goes by, the wooden shingles darken in color. The wooden shingles also absorb a substantial amount of heat in the form of solar radiation. The darker the shingle, the greater the degree of heat absorption.

Shingles of the asphalt type may come in a variety of colors, ranging from dark brown to a fairly light grey. Obviously, the lighter the shingle color the greater the degree of reflection of solar radiation. Conversely, the darker the color of the shingle, the greater the degree of heat absorption from solar radiation.

In addition to shingles, tile roofs may also be found in various parts of the United States and, of course, throughout the world. Typically such slate or tile roofs are of a dark color, although it may be quite bright, colorwise, which also reflects very little solar radiation and absorbs a substantial amount of solar radiation.

The only shade received by roofs is primarily in residential neighborhoods where trees adjacent the structure provide some degree of shade at different times of the day, depending on the size of the tree, size of the roof structure, the roof of the structure, and other variables.

SUMMARY OF THE INVENTION

The roof apparatus disclosed and claimed herein, and comprising the present invention, includes a plurality of overlapping louvers or fins which extend away from the main portion of a roof covering. The overlapping louvers provide shade for reflecting solar radiation and for preventing the solar radiation from impinging directly onto the roof of a structure. The louvers are spaced apart from the roof structure and accordingly act as fins to allow for the circulation or passage or air about the louvers to conduct away or transfer any heat absorbed by the louvers to the circulating air.

Among the objects of the present invention are the following:

To provide new and useful roof apparatus;

To provide new and useful roof apparatus including a plurality of louvers;

To provide new and useful roof apparatus for providing shade to a roof;

To provide new and useful roof apparatus including overlapping louvers;

To provide new and useful roof apparatus which allows air to circulate through the roof apparatus; and To provide new and useful roof apparatus including a plurality of overlapping louvers for use on pitched roofs.

DESCRIPTION OF THE PREFERRED EMBODIMENT

Figure 1:
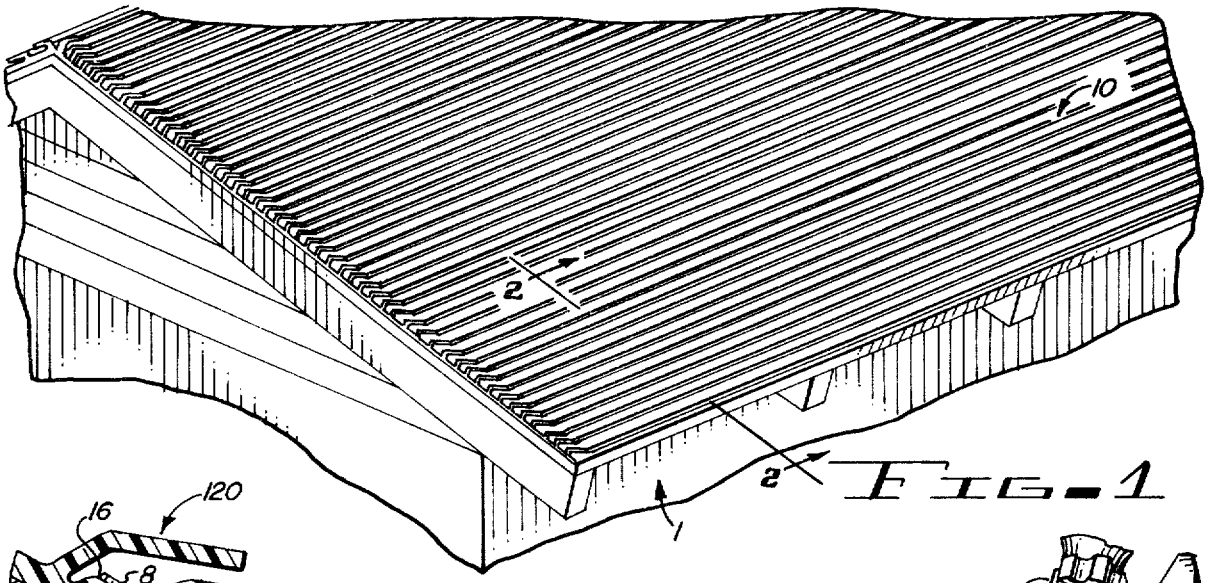
FIG. 1 is a perspective view of a pitched roof structure illustrating the use of the present invention on the roof.
Figure 2:
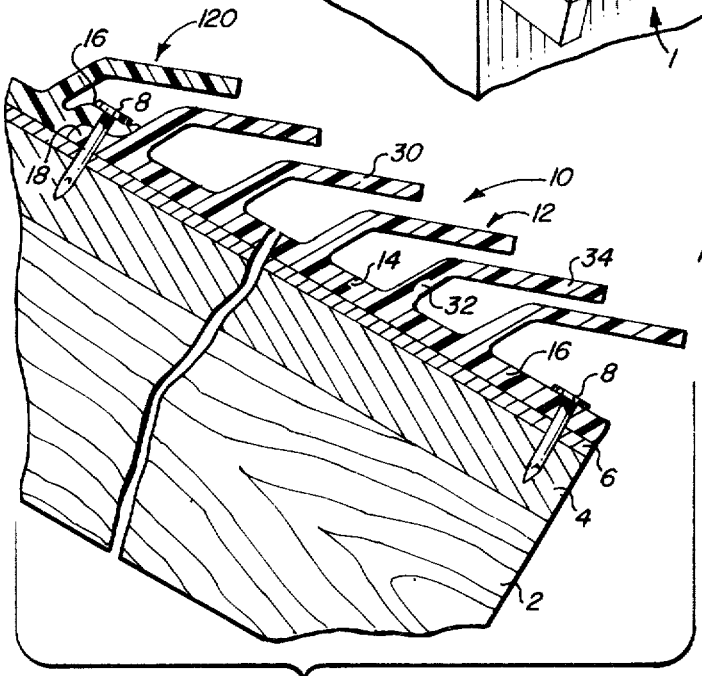
FIG. 2 is a view in partial section taken generally along line 2—2 of FIG. 1.
Figure 3:
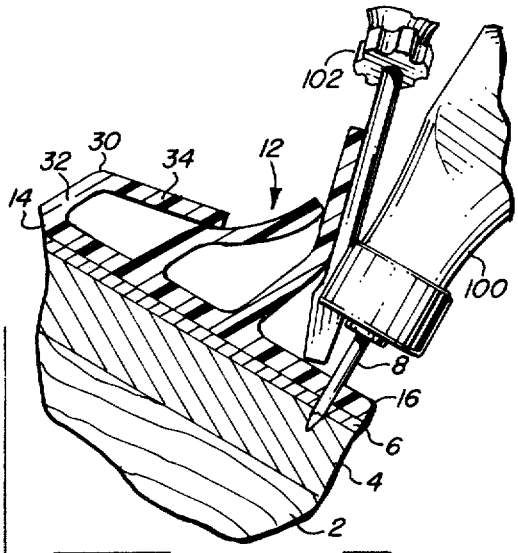
FIG. 3 is a view in partial section illustrating the installation of the roof apparatus of the present invention.

FIG. 1 is a perspective view of a structure 1 which includes a pitched roof. The covering for the roof comprises roof louver apparatus 10 embodying the present invention. FIG. 2 is a view in partial section of a portion of the apparatus of FIG. 1 taken generally along line 2—2 of FIG. 1. FIG. 3 is an enlarged view in partial section, also of a portion of the roof apparatus of FIGS. 1 and 2, illustrating the installation of the roof apparatus of the present invention.

FIGS. 1 and 2 will be generally described together, and accordingly references should be made to both FIGS. 1 and 2 in the following discussions.

A cross-sectional view of a typical pitched roof, such as illustrated in FIGS. 1, 2, and 3, includes a rafter 2, with a layer 4 of sheathing, such as plywood, disposed on the rafters as a roof base. On top of the sheathing is a layer 6 of waterproof material, typically tarpaper. Over the waterproof layer 6 is disposed the final or outer roof covering, such as a plurality of panels 12 of roof louver apparatus 10. The roof of the structure 1 is pitched, and accordingly there is an "upper" and a "lower" portion or direction for each roof panel 12 and for the plurality of louvers or fins on each panel. The fins or louvers are arranged in parallel rows extending lengthwise or horizontally on the panels on the roof, as best shown in FIG. 1. The extent or amount of the shade provided by the louvers or fins, which louvers or fins are discussed in detail below, depends on the slope or pitch of the roof, the latitude of the structure (for the angle of the sun), and the season of the year and the time of the day.

Each panel 12 includes a base 14 with a plurality of fins or louvers 30 secured to the base. The fins or louvers 30 include what may be termed a vertical or first portion 32, which extends upwardly from the base portion at what is actually something less than a ninety degree angle, or less than perpendicular. A flat or shade second portion 34 extends outwardly from the vertical first portion at an angle less than ninety degrees to the vertical portion to define an awning over the adjacent fin. The flat or second portion 34 extends over the base at an acute angle with respect to the base, and succeeding flat portions accordingly overlap the adjacent flat portion to provide shade for both the roof and adjacent fins or louvers. Each flat or shade portion 34 of a fin or louver 30 extends over the vertical portion 32 and part of the shade portion 34 of the adjacent lower louver. Each fin or louver is spaced apart from adjacent louvers for unrestricted air movement.

A shown best in FIG. 2, the base of each panel includes a "leading" edge 16 and a "trailing" edge 18. The leading edge 16 is generally longer dimensionally than the trailing edge 18. The lowest or bottom fin or louver 30 disposed next to the leading edge overlays or overlaps the leading edge. The leading edge is generally the lowest portion of the panel or installation, as shown in FIGS. 2, and 3.

As also illustrated in FIG. 2, when panels are disposed in abutting relationship, the leading edge of one panel is disposed above the trailing edge of the next succeeding or lower panel to provide a continuous overlap. In FIG. 2, a nail 8 is shown extending through the leading edge 16 of a panel 120 and through the trailing edge 18 of the adjacent, lower panel 12. The leading edge 16 is shown overlapping the trailing edge 18, thus providing a continuous seal at the juncture of the two adjacent panels. Another nail 8 is shown extending through the leading edge 16 of the panel 12 at the lower edge of the roof.

The roof apparatus 10 is preferably made of flexible or semi-rigid material to enable the fins or louvers to "give" or flex as required both in installation and afterwards while in use. For example, it may be necessary to walk on the roof, and, if so, the fins or louvers must "give" in order not to break. However, the fins or louvers should be sufficiently rigid so as not to "flap" or "wave" in a wind. Moreover, expansion and contraction problems of the roof are minimized when the roof is flexible or semi-rigid.

For purposes of installation, a degree of flexibility is illustrated in FIG. 3, which shows a hammer 100 being used to drive a nail 8 through a leading edge 16 of a panel 12 through a layer of tar paper 6 and into a layer of sheathing 4. In order to move a fin 30 out of the way of the hammer and nail, a screwdriver 102, or a similar instrument, such as a paddle, or the like, may be used, if desired.

With the roof apparatus being flexible or non-rigid, the fins or louvers 30 are easily moved out of the way to enable necessary nails or other fastening means to be driven through the roof apparatus panels to secure the respective panels to the roof. After a nail has been driven into the roof, the screwdriver or paddle is removed, and the flexibility of the fins or louvers allows them to return to their normal orientation, such as shown in FIG. 2.

In cold climates, where snow is encountered, the fins or louvers 30 may also flex or bend under the weight of snow. This results in the contact of adjacent flat or shade portions 34 of the fins 30. In turn, this results in dead air spaces beneath the flat portions and between the adjacent vertical portions 32 of the fins above the base 14. The roof apparatus 10 thus provides dead air space for insulation under snow conditions.

Figure 4:
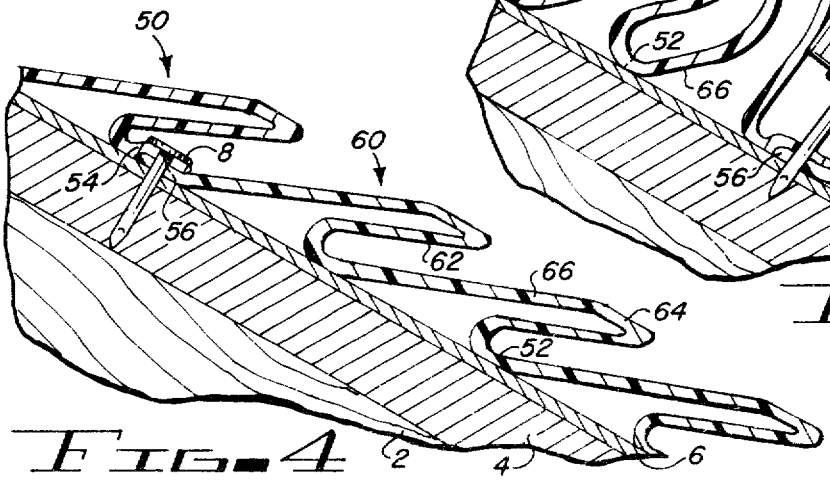
FIG. 4 is a view in partial section showing an alternate embodiment of the apparatus of FIGS. 2 and 3.
Figure 5:
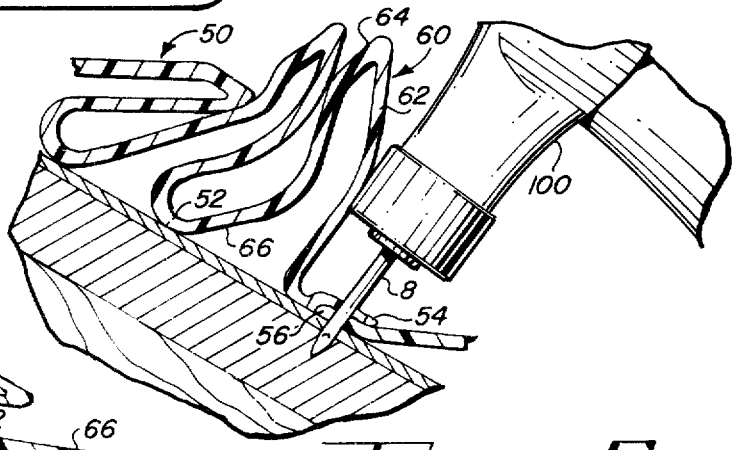
FIG. 5 is a view in partial section illustrating the installation of the apparatus of FIG. 4.

FIGS. 4 and 5 disclose an alternate embodiment of a roof apparatus illustrated in detail in FIGS 2 and 3. The primary difference between the embodiment of FIGS. 2 and 3 and the embodiment of FIGS. 4 and 5 is that the embodiment of FIGS. 2 and 3 has a continuous base, and a single louver or fin, while the embodiment of FIGS. 4 and 5 does not have a continuous base. Rather, the base is simply a continuation of the adjacent fin portions, and double fins are used with the embodiment of FIGS. 4 and 5. The use of the double fin allows a different type of air circulation from that of the embodiment of FIGS. 2 and 3. The circulation of air in the embodiment of FIGS. 2 and 3 is above and below each of the fins, or between the fins, longitudinally. The circulation of air in the continuous fin or louver arrangement of FIGS. 4 and 5 allows the air to circulate not only above and below, but also between the fin sections.

Alternate roof louver apparatus 50 illustrated in FIGS. 4 and 5 is also preferably made in panels, such as discussed above in conjunction with FIGS. 1, 2, and 3. The alternate louver or fin apparatus 50 of FIGS. 4 and 5 includes a relatively small base section or portion 52 which is disposed against, or on top of, the tar paper coating 6 on the sheathing 4 of the structural roof. That is, only the relatively narrow base 52 comes in direct contact with the roof, while fins or louvers 60 are disposed away from, and thus do not directly contact, the roof. Instead of having a continuous base, the roof apparatus 50 includes a small base section 52 for each fin or louver 60.

Each panel includes a leading edge 54 and a trailing edge 56, which function substantially the same as the leading and trailing edges 16 and 18, respectively, illustrated above and discussed in detail with respect to FIGS. 2 and 3. In FIGS. 4 and 5, the leading edge 54 is shown disposed on top of, and thus overlapping, the trailing edge 56 of an adjacent panel. A nail 8 is shown in FIG. 4 as securing the leading and trailing edges of adjacent panels.

In FIG. 5, a fin 60 adjacent the leading edge 54 of a panel is shown biased away from the leading edge 54 to allow for a nail 8 to be driven into the joint or juncture of the leading and trailing edges of the adjacent panels by a hammer 100.

The fins 60 of the embodiment of FIGS. 5 and 6 are flexible or semi-rigid, as discussed above in conjunction with the embodiment of FIGS. 2 and 3. Accordingly, an instrument, such as a screwdriver, paddle, or the like, may be used to bias fins out of the way for nailing or fastening purposes.

The structure of the fins 60 of the embodiment of FIGS. 4 and 5 includes a lower portion 62, an outer connecting portion 64, and an upper portion 66. The upper and lower portions are substantially parallel to each other, and are spaced apart by the connecting portions. It will be noted that fins or louvers 60 provide shade for adjacent or next lower fins by the overlying disposition or arrangement of the fins. Preferably, the fins are generally parallel to each other, and the connecting portions 64 are generally in the same plane and are aligned with adjacent connecting portions. As best shown in FIG. 4, the lower portion 62, the connecting portion 64, and part of the upper portion 66, of each fin or louver 60 is disposed over, and thus shades, the base 52 and part of the upper portion 66 of each adjacent lower louver 60.

The upper portions 66, which comprise first portions, are connected to the base portions 52, as are the lower or second portions 62. Each louver is thus connected to two base portions.

Air flow, as discussed above, is relatively unrestricted between adjacent fins or louvers and between the upper and lower portions of the fins with shaded pockets of air between the adjacent louvers. The air flow structure in both embodiments as disclosed herein is relatively unrestricted to provide for the inherent cooling of the fins or louvers by the movement of air. In this regard the fins or louvers act as radiating surfaces to dissipate heat in addition to the shade which they provide for adjacent fins or louvers.

The flexibility or semi-rigidity of the louver apparatus 50 of FIGS. 4 and 5 is substantially the same as that of the apparatus 10 of FIGS. 1-3. Accordingly, the flexing without breaking when walked on and the flexing under the weight of snow are again appropriate characteristics of the apparatus 50. Moreover, dead air space insulative properties are also inherent with the apparatus 50.

A more costly panel may result by combining the double louver of FIGS. 4 and 5 with the continous base of FIGS. 1-3. A continuous base provides more protection for a new roof with only tarpaper disposed on sheathing. However, if the apparatus of the present invention is installed on an old roof, as on top of an asphalt shingled roof or a roof of rolled asphalt covering, the apparatus of FIGS. 4 and 5 will be enirely satisfactory.

The continuous base of FIGS. 1-3, as discussed above, and as shown best in FIGS. 2 and 3, comprises a continuous sheet 14 disposed on the roof. The base of FIGS. 3 and 4 is not a continuous sheet, but as discussed above, and as shown in FIGS. 4 and 5, comprises a plurality of relatively narrow strips 52 which extend generally horizontally and parallel to the double louvers or fins 60. It will be noted that both the lower portions 62 and the upper portions 66 of each louver are secured to a base strip, or to adjacent base strips. That is, a lower portion 62 of one louver and an upper portion 66 of an adjacent louver are secured to the same base strip 52. The plurality of base strips are parallel to, and spaced apart from each other.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Roof panel apparatus for providing shade for a pitched roof, comprising, in combination:
   - a pitched roof;
   - base means secured to the pitched roof;
   - louver means secured to the base means and comprising a plurality of generally horizontally extending rows of louvers spaced apart from each other, and each louver includes
   - a first portion secured to the base means and extending outwardly therefrom;
   - a second portion secured to the first portion and extending over part of an adjacent lower louver but spaced therefrom to provide a shaded pocket of air above the adjacent lower louver and the roof.

2. The apparatus of claim 1 in which the base means comprises a continuous base disposed on and secured to the pitched roof.

3. The apparatus of claim 1 in which the base means comprises a plurality of strips.

4. The apparatus of claim 3 in which the louver means further includes a third portion, and the first portion comprises an upper portion secured to one base strip, the second portion comprises a lower portion secured to an adjacent base strip and disposed substantially parallel to and spaced apart from the first portion, and the third portion comprises a connecting portion between the first and second portions.

5. The apparatus of claim 1 in which the second portion is secured to the first portion and is spaced apart from the base means.

* * * * *